United States Patent [19]

Wilnau

[11] Patent Number: 5,072,565

[45] Date of Patent: Dec. 17, 1991

[54] PRE-CAST CONCRETE WALL PANEL AND JOIST ASSEMBLY AND METHOD OF CONSTRUCTION

[76] Inventor: Don Wilnau, 907 Hibernia Forest Dr., Green Cove Springs, Fla. 32043

[21] Appl. No.: 452,722

[22] Filed: Dec. 19, 1989

[51] Int. Cl.[5] ..... E04C 2/50

[52] U.S. Cl. ..... 52/600; 52/334

[58] Field of Search ..... 52/600, 602, 630, 329, 52/330, 331, 333, 334, 335, 337, 338, 339

[56] References Cited

U.S. PATENT DOCUMENTS

| | | | |
|---|---|---|---|
| 3,362,121 | 1/1968 | Weber | 52/338 |
| 3,845,594 | 11/1974 | Butts et al. | 52/334 |
| 4,432,178 | 2/1984 | Taft | 52/334 |
| 4,592,184 | 6/1986 | Person et al. | 52/334 |
| 4,715,155 | 12/1987 | Holtz | 52/334 |
| 4,729,201 | 3/1988 | Laurus et al. | 52/334 |

*Primary Examiner*—Michael Safavi

*Attorney, Agent, or Firm*—Thomas C. Saitta

[57] ABSTRACT

A pre-cast concrete panel and joist assembly and a method for forming and constructing this pre-cast concrete panel and joist assembly used as a wall member, comprising the steps of creating a mold to receive wet concrete, positioning reinforcing members, joist attachment plates and weld plates within the mold, pouring wet concrete into the mold, embedding anchor members in the concrete, attaching joists to the concrete panel, and attaching bridging members between the joists and the concrete panel. The joists may be constructed with or without an exterior chord.

12 Claims, 2 Drawing Sheets

FIG. 1
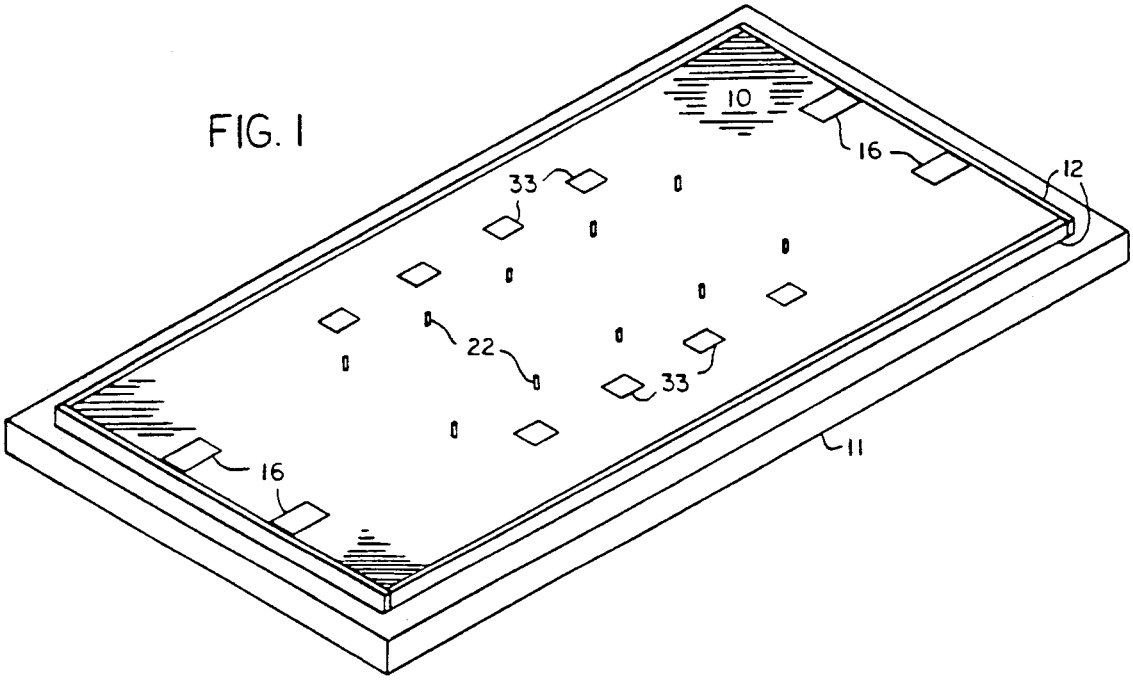
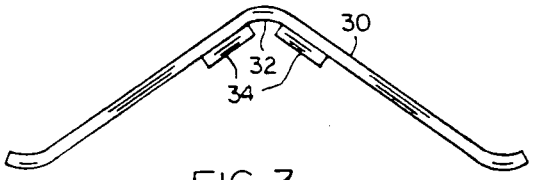
FIG. 3
FIG. 2
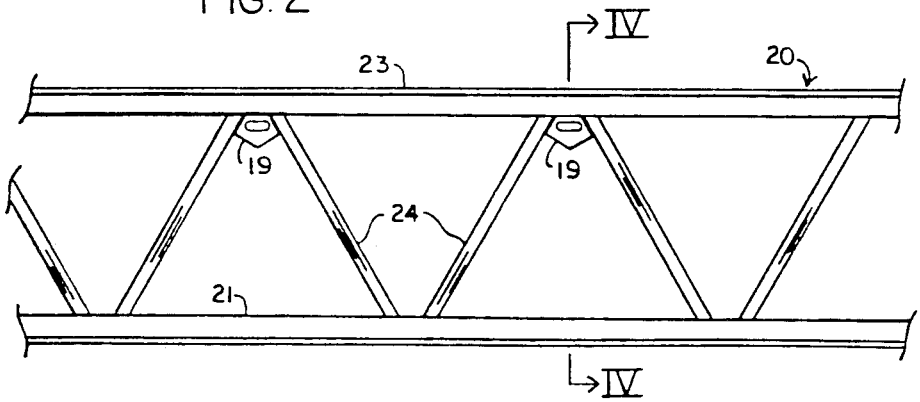

FIG. 4
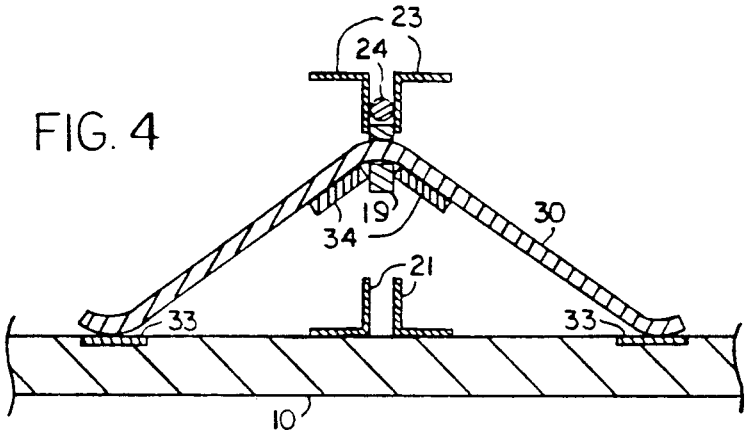
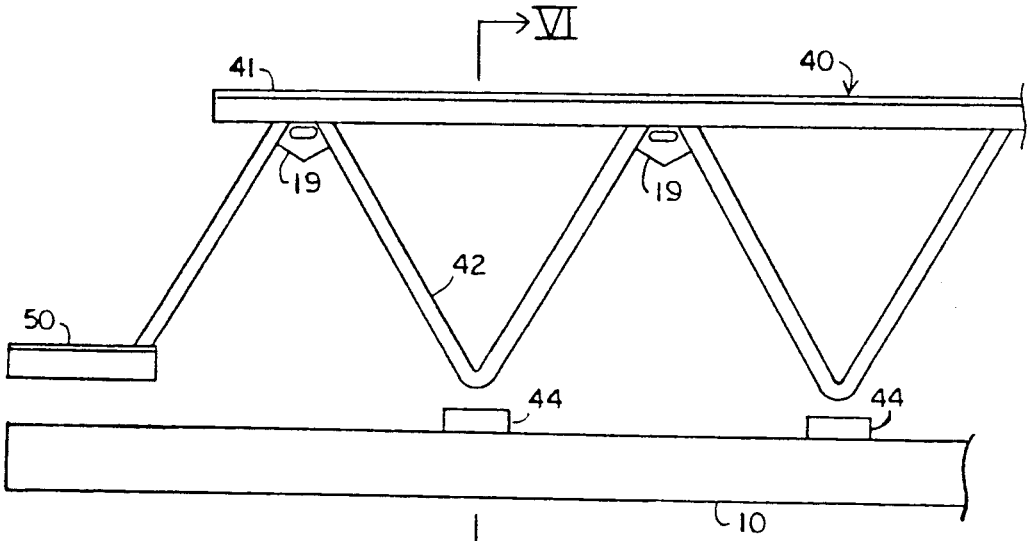
FIG. 5
FIG. 6
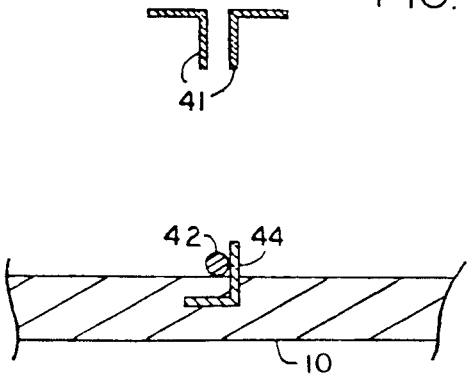

PRE-CAST CONCRETE WALL PANEL AND JOIST ASSEMBLY AND METHOD OF CONSTRUCTION

BACKGROUND OF THE INVENTION

The invention relates to the field of constructing pre-cast concrete panel and joist assemblies used in the construction industry, and more particularly to the field of forming such assemblies off-site and subsequently transporting the completed assemblies to the construction site for use as exterior wall members. Specifically, the invention relates to the field of pre-cast wall panels with lateral bridging members to counter the effects of wind load and suction, and the method of constructing such assemblies.

In traditional construction practice, walls in buildings are constructed from masonry blocks or are poured directly into forms set on the floor slab and then tilted into place after hardening. Both these methods are time consuming and the latter method greatly interferes with other construction operations because the floor space is occupied during the forming phase. Furthermore, the walls must be made relatively thick to withstand the effects of wind load and suction.

To provide a better system, a method has been developed for pre-fabricating concrete slab and joist assemblies to be used as walls. A number of pre-cast concrete panel and joist assemblies can be made and transported to the construction site, ready for installation at the first opportunity. Since the assemblies are pre-cast, construction is not delayed to wait for the setting of the poured concrete. The assemblies are modular in the sense that a number of assemblies are placed in position by crane and then joined together to form a continuous wall assembly. Because the assemblies are combined concrete slabs and joists, the slab itself can be thinner than a standard slab, saving expense and weight without sacrificing strength. A standard wall slab made in the traditional manner without joists is much thicker and too massive to transport easily. As with all construction, it is desirable to reduce the number of steps required, use less materials and simplify the operations. The concrete panel and joist assemblies are easily transportable and can be erected on site using light-weight equipment.

While it is well known to form pre-cast concrete panel and joist assemblies for use as floors or other load bearing members, this type of construction has not been applied to walls. Pre-cast wall panels must take into consideration and account for wind effects not encountered in floor situations. With floor panels, load forces in the downward or weight bearing direction are the only forces encountered. With wall panels however, the effect of wind on the upright exterior walls means that either wind load or wind suction may be present. That is, a pre-cast wall panel must be able to withstand stresses in both directions—a compressive load toward the interior of the building and a tensile load or suction toward the exterior of the building. The interior chords of the joists will be in tension in the compressive load situation and in compression in the suction situation. The standard methods for forming pre-cast panels do not take these factors into consideration, and if panels made from such methods are used in exterior walls, can result in a construction not able to withstand the stresses caused by wind.

To overcome the problems outlined above, the method of the invention provides for constructing a pre-cast concrete panel and joist assembly able to withstand both compressive loads and suction. The method incorporates the step of adding bridging members to interconnect the joists and concrete panel, the bridging providing the necessary lateral stability to overcome the problems of the wind effects. The specific structure and design of the bridging members and joist enable quick, efficient construction, and the resulting concrete panel and joist assembly is distinct from previously known assemblies.

It is an object of this invention to provide a pre-cast concrete panel and joist assembly able to be used as a wall member, and to provide a method of pre-casting and constructing such assembly.

It is an object of the invention to provide a method of pre-casting and constructing concrete slab and joist assemblies with lateral bridging members which is simple in operation.

It is a further object of this invention to provide such a method where pre-constructed joists are attached to a pre-cast, hardened concrete panel and lateral bridging members are easily interlocked with the joists.

It is a further object of the invention to provide a pre-cast panel and joist assembly having interlocking lateral bridging members.

It is a further object of the invention to provide such an assembly where the joist does not require an exterior chord, so that the overall depth of the assembly is reduced.

SUMMARY OF THE INVENTION

The invention is a concrete panel and joist assembly comprising a number of joists attached to a pre-cast concrete panel by attachment means and anchor members embedded in the concrete slab. Preferably, substantially V-shaped bridging members are interfit through apertured plates attached to the joists and the ends of said bridging members are attached to said concrete panel.

The method of the invention involves initially setting up a form to receive the concrete. The form is created by placing four side members in a rectangular shape on a flat, smooth surface capable of supporting the weight of the concrete. The surface is coated with a release material to prevent adhesion of the poured concrete. Reinforcing members, such as rebar or welded wire mesh, are positioned in the central portion of the mold. Metal joist attachment plates are positioned at each end so that the surface of the plates will be flush with the upper surface of the poured concrete. The concrete is poured and joist anchor members for attaching the joists are set into the wet concrete. The concrete is allowed to completely harden. Joists are then attached to the concrete panel by welding or mechanically fastening the exterior chords to the metal joist attachment plates and attaching each of the joist anchor members. Substantially V-shaped bridging members are slotted through apertures in the joists, forming a mechanical interlock, and the ends of the bridging members are attached to anchoring members in the concrete panel. The assemblies are then removed from the molds by crane, transported to the construction site, placed upright and set into place.

In an alternative embodiment, the concrete panel and joist assembly comprises joists having no exterior chords, the webbing of the joist being attached directly to the concrete panel. An extended chord can be added to the webbing of the joists at the ends to allow closer attachment of the assembly to other structural members. In this method, joists having no exterior chords are prepared. The form is set up, coated and reinforced as described above. Concrete is then poured into the form. Before the concrete hardens, webbing attachment means are set into the surface of the concrete at locations corresponding to the positions of the exposed joist webbing. After the concrete has hardened, the joists are positioned on the concrete panel and attached by welding the webbing to the webbing attachment means. Interlocking bridging members are then secured to the joists and attached to the concrete panel. An extended chord can be added to the ends of the joists adjacent the concrete panel by welding angle iron to the webbing.

BRIEF DESCRIPTION OF THE DRAWINGS

FIG. 1 is a perspective view of the form as filled with wet concrete, and showing the joist attachment plates, joist anchor members and bridging anchor members.

FIG. 2 is a side view of a standard joist with apertured plates for receiving the bridging members.

FIG. 3 is a view of a bridging member.

FIG. 4 is a cross-sectional view taken along line IV—IV of FIG. 2, showing a bridging member interfitted with the joist and attached to the concrete panel.

FIG. 5 is a view of a joist having an interior chord and webbing, but no exterior chord, and the concrete slab with embedded webbing attachment means.

FIG. 6 is a cross-sectional view taken along line VI—VI of FIG. 5 showing a joist having no exterior chord attached to the concrete slab.

DETAILED DESCRIPTION OF THE INVENTION

The method of constructing the pre-cast concrete wall panel and joist assembly comprises initially setting up a mold in which to cast the panel. The assemblies can be cast at a manufacturing site and then shipped to various installation sites, or the molds can be built at the installation location where it is desirable to preclude transporting the finished assemblies, if there is enough room to accommodate them without interfering with construction.

Typically, a smooth, planar concrete slab or steel table 11 is used as the backer surface and a four sided form is placed on this surface to form the perimeter of the panel, as shown in FIG. 1. The form members 12 can be of wood or metal and can be bevelled or angled on the interior side of at least two of the form members 12. After the form members 12 are set in place, the bottom of the mold is coated with a mold release, such as form oil or bond breaker, to insure that the wet concrete will not bond to the slab or table surface 11. Additionally, liner panels of rubber, fiberglass or wood can be placed on the mold bottom to create patterns or designs in the finished panel, if desired.

Reinforcements, of any type generally known in the art, are then positioned within the mold so that the reinforcement members will be contained within the concrete panel 10 upon completion. For example, rebar, welded wire mesh or pre-stressed tendons may be used to provide additional strength within the finished concrete panel 10. Also at this time, steel weld plates may be positioned adjacent the side of the forms. The weld plates have an anchoring member which extends into the interior of the mold such that this anchoring member will be embedded in the interior of the finished concrete panel. The exterior surface of these weld plates will be flush with the edge of the finished concrete panel 10 and are positioned so that the weld plates of adjacent panels will abut each other. The adjacent weld plates can then be welded together on site to join separate wall panels.

Pairs of joist attachment means 16 are set into the mold at interior positions on opposites sides of the form members 12 where the ends of the joists 20 are to be eventually attached to the panel 10. These joist attachment means 16 are steel plates to which the exterior chord 21 of the joist 20 is welded. The joist attachment plate 16 consists of a steel plate positioned to be flush with the surface of the concrete poured into the mold, with anchoring mean extending into the interior of the mold to be embedded in the interior of the concrete panel 10. The joist attachment means 16 can be constructed from short segments of angle iron. For a three inch thick panel 10, the joist attachment plate 16 will be positioned so that its upper surface is three inches above the mold bottom.

Wet concrete is now added to fill the mold to the desired level, typically three to six inches in depth. The wet concrete surrounds the reinforcement members and the anchoring means of the joist attachment plates 16. The outer surface of the concrete is flush with the outer surfaces of the joist attachment plates 16 and weld plates, if present.

Before the concrete sets, joist anchor members 22 are inserted into the concrete at intervals on lines running between opposite joist attachment plates 16. These joist anchor members 22 are used to attach the exterior chord 21 of the joist member 20 to the finished concrete panel 10. Joist anchor members 22 may be anchor bolts or vertically extending weld plates partially embedded in the concrete panel 10. Another alternative for attaching the joist members 20 is to allow the panel 10 to harden and then drill holes for insertion of wedge or sleeve anchor members. Also at this time, bridging anchor members 33 may be inserted into the wet concrete at the required locations along both sides of the joist line for attachment of the legs of the bridging members 30 during later assembly.

After the concrete panel 10 has hardened, usually a period of roughly 24 hours, the joists 20 are attached to the panel 10. The joists 20, as shown in FIG. 2, are of the standard construction, having a continuous exterior chord 21 and a continuous interior chord 23 made of angle iron connected by webbing material 24 alternating between the two chords.

The joists 20 are attached by inverting them such that the exterior chord 21 rests on the surface of the hardened concrete panel 10 and extends from one joist attachment plate 16 to its opposing joist attachment plate 16, following the line of the embedded joist anchor members 22. The exterior chord 21 is permanently joined to the concrete panel 10 by attaching the joist anchor members 22 to the chord 21, and also welding or mechanically fastening the exterior chord 21 to the joist attachment plates 16.

Because the concrete panel and joist assembly is to be used as a wall, consideration must be given to the effects of wind on the panel 10. A wall will be exposed to both wind load and to wind suction, wind load being a force against the exterior of the panel 10 causing the interior chord 23 to be in tension and wind suction being a force in the opposite direction causing the interior 23 chord to be in compression. Since the interior chord 23 is designed to be in tension, wind suction is the main problem to be compensated for.

This is done by adding bridging members to further stabilize the joists. Preferably, lateral bridging members 30, as shown in FIG. 3, are attached at intervals along the joist 20 which stay the joist 20 laterally and provide sufficient additional strength to compensate for the effects of wind suction on the panel 10. Apertured plates 19 for receiving the bridging members 30 are attached at positions along the joist 20. The apertured plates 19 are planar with an elongated aperture or slot, the major axis of the slot paralleling the major chord direction. The apertured plates 19 are attached by welding the plates 19 to portions of the interior webbing 24 near or adjacent the interior chord 23. The bridging members 30 are short, substantially V-shaped sections of weldable material such as rod steel stock. The bridging members 30 are constructed so as to have a vertical slot 32 located at the interior of the V-angle. The slot 32 is formed by attaching short flanges or segments 34 of rod steel stock on both legs adjacent the V-angle of the bridging member 30, separated by a distance equal to the thickness of the apertured plate 19. As seen in FIG. 4, the bridging members 30 are inserted through the apertures and rotated 90 degrees so that the ends rest on the concrete panel 10 on either side of the joist 20. The slot 32 of the bridging member 30 interfits tightly with the apertured plate 19 so that no additional fastening or welding is required to provide a fixed connection. The legs of the bridging member 30 are then attached to the concrete panel 10 by chemical bonding or with expansion bolts drilled into the panel 10, or by attaching the legs of the bridging member 30 to previously embedded bridging anchor members 33.

The concrete panel and joist assembly is then lifted by crane from the mold, transported to the installation site, stood upright and set into place. The assembly comprises a number of joists 20 permanently attached to the concrete panel 10, each joist 20 being further attached to said concrete panel 10 by a number of V-shaped bridging members 30 extending to each side where the ends are attached to the panel 10. The bridging members 30 have a slot 32 which interfits with the openings in apertured plates 19 attached to the webbing 24 near the interior chord 23, such that an firm mechanical attachment is achieved and no further fastening is required. The bridging members 30 provide the necessary lateral stability to allow the relatively thin concrete panel 10 to be used as an exterior wall.

In an alternative embodiment, the panel and joist assembly is constructed using joist members 40 that do not have exterior chords, as shown in FIG. 5. Each joist 40 consists of an interior chord 41 and webbing 42, where the folded ends of the webbing 42 are exposed. By eliminating the exterior chord, a significant savings in construction costs can be realized. Furthermore, the overall depth of the panel and joist assembly is reduced roughly fifteen percent without sacrificing strength. The direct attachment of the webbing 42 to the concrete panel 10 in combination with the lateral bridging members 30 enables the assembly to withstand both the wind load forces and suction.

The mold is prepared as previously outlined by setting up the forms, applying the mold release material and positioning the reinforcing members. However, no joist attachment plates are required, so the next step is to pour the wet concrete into the mold to the desired level.

Before the concrete has hardened, webbing attachment means 44, as seen in FIG. 6, are inserted into the concrete at intervals along the desired joist line at distances matching the distance between the ends of the exposed webbing 42. These webbing attachment means 44 are preferably constructed from short segments of angle iron. The webbing attachment means 44 are set into the concrete such that the angle is contained within the interior of the panel 10 to anchor the webbing attachment means 44 once the concrete has hardened. A planar portion of the angle iron extends vertically from the concrete a few inches, each planar portion being aligned along the joist position line. After the concrete has hardened, joists 40 having only an interior chord 41 and webbing 42, but no exterior chord, are positioned on the panel 10 such that the each extended portion of the webbing 42 contacts the webbing attachment means 44. The joists 40 are then permanently attached to the concrete panel 10 by welding the webbing 42 to the webbing attachment mean 44.

As before, bridging members 30 are now attached to the joist 40 at intervals by interlocking the bridging member 30 to the bridging attachment plates 19 affixed to the webbing 42. The bridging members 30 are then attached to the concrete by any of the methods outlined above. The resulting concrete panel and joist assembly is fully capable of withstanding the wind stresses, yet is more compact in depth and lighter because of the lack of the exterior chords in the joists. Furthermore, such joists are less expensive since less materials are required for their construction.

In a further embodiment of this assembly, a short segment of chord is attached to the webbing 42 on one or both ends of the joists 40 so that this extended chord 50 is adjacent the concrete panel 10 and extends beyond the end of the interior chord 41. This extended chord 50, shown in FIG. 5, may be attached to the concrete panel 10 by any suitable method as previously described, including the method of embedding joist attachment plates 16 in the concrete slab. This extended chord 50, because it extends beyond the ends of the interior chord 41, allows the panel and joist assembly to be attached to other building components in a more compact manner, since the building components will abut the extended chords 50 rather than being attached to the interior chords 41 of the assembly.

It will be obvious to those skilled in the art that equivalents and substitutions may be made in the above descriptions. The full scope and definition of the invention therefore is to be as set forth in the following claims.

I claim:

1. A pre-cast concrete panel and joist assembly comprising:

(A) a concrete panel substantially rectangular in configuration;

(B) at least one joist attached to said concrete panel, said joist having an exterior chord and an interior chord made of angle iron, and webbing material alternating between said chords;

(C) joist attachment means for attaching said exterior chord of said joist to said concrete panel, (D) bridging members to stabilize said joist;

(E) apertured plates attached to said joist;

(F) bridging anchor members attached to said concrete panel;

where said bridging members are substantially V-shaped bridging members having two legs and a slot at the main angle, where said bridging members extend through said apertured plates, said slot interlocking with said apertured plate, and where said legs are attached to said bridging anchor members.

2. The assembly of claim 1, where said joist attachment means are plates embedded in opposite ends of said concrete panel, where said exterior chords of said joist are attached to said plates.

3. The assembly of claim 1, where said joist attachment means are joist anchor members embedded in said concrete panel at intervals along the length of said joist, where said exterior chords of said joist are attached directly to said joist anchor members.

4. The assembly of claim 1, where said apertured plates are relatively planar plates having an elongated opening, and said apertured plates are attached to said webbing of said joist adjacent the interior chord.

5. The assembly of claim 1, where said bridging members are formed of a bent segment of rod stock and said slot is formed by attaching two short segments of rod stock to the bent segment in the interior of the angle, the two short segments being separated by a distance equal to the thickness of said apertured plate.

6. The assembly of claim 3, where said joist anchor members are bolts.

7. The assembly of claim 3, where said joist anchor members are weldable plates.

8. A pre-cast concrete panel and joist assembly comprising:

(A) a concrete panel substantially rectangular in configuration;

(B) at least one joist attached to said concrete panel, said joist having only an interior chord made of angle iron, and webbing material alternating from said chord to said concrete panel;

(C) webbing attachment means embedded in said concrete panel and directly attached to said webbing of said joist;

(D) apertured plates attached to said joist;

(E) bridging anchor members attached to said concrete panel;

(F) substantially V-shaped bridging members having two legs and a slot at the main angle, where said bridging members extend through said apertured plates, said slot interlocking with said apertured plate, and where said legs are attached to said bridging anchor members.

9. The assembly of claim 8, where said webbing attachment means are weldable plates extending from said concrete panel at intervals along the length of said joist.

10. The assembly of claim 8, where said apertured plates are relatively planar plates having an elongated opening, and said apertured plates are attached to said webbing of said joist adjacent the interior chord.

11. The assembly of claim 8, where said bridging members are formed of a bent segment of rod stock and said slot is formed by attaching two short segments of rod stock to the bent segment in the interior of the angle, the two short segments being separated by a distance equal to the thickness of said apertured plate.

12. The assembly of claim 8, further comprising one or more extended chords attached to the webbing of some of said joist, where said extended chords are formed of short segments of angle iron attached to said webbing adjacent said concrete panel and extending beyond the ends of said interior chords.

* * * * *